US010160227B2

(12) United States Patent
Ross et al.

(10) Patent No.: US 10,160,227 B2
(45) Date of Patent: Dec. 25, 2018

(54) DUAL AND SINGLE DROP WEIGHT PRINTING

(71) Applicant: Hewlett-Packard Development Company, L.P., Houston, TX (US)

(72) Inventors: George C. Ross, Philomath, OR (US); Ron Burns, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/543,546

(22) PCT Filed: Apr. 30, 2015

(86) PCT No.: PCT/US2015/028415
§ 371 (c)(1),
(2) Date: Jul. 13, 2017

(87) PCT Pub. No.: WO2016/175812
PCT Pub. Date: Nov. 3, 2016

(65) Prior Publication Data
US 2017/0368838 A1 Dec. 28, 2017

(51) Int. Cl.

| | |
|---|---|
| ***B41J 2/14*** | (2006.01) |
| ***B41J 2/21*** | (2006.01) |
| ***B41J 2/155*** | (2006.01) |
| ***B41J 2/045*** | (2006.01) |
| *B41J 29/38* | (2006.01) |

(52) U.S. Cl.
CPC ..... *B41J 2/2125* (2013.01); *B41J 2/0458* (2013.01); *B41J 2/04551* (2013.01); *B41J 2/04593* (2013.01); *B41J 2/1412* (2013.01); *B41J 2/155* (2013.01); *B41J 2/2121* (2013.01); *B41J 2/2128* (2013.01); *B41J 2/2146* (2013.01); *B41J 29/38* (2013.01); *B41J 2002/14475* (2013.01)

(58) Field of Classification Search
CPC ..... B41J 2/2125; B41J 2002/14475
See application file for complete search history.

(56) References Cited

U.S. PATENT DOCUMENTS 5,692,843 A 12/1997 Furuya
6,030,065 A * 2/2000 Fukuhata ..... B41J 2/14016 347/15

(Continued)

FOREIGN PATENT DOCUMENTS

CN 1453133 11/2003
CN 100515772 7/2009

(Continued)

OTHER PUBLICATIONS

Gan, et al "Reduction of Droplet Volume by Controlling Actuating Waveforms in Inkjet Printing for Micro-pattern Formation", Jml of Micromech. and Microeng. vol. 19 No. 5, 1pg.

*Primary Examiner* — Julian D Huffman
(74) *Attorney, Agent, or Firm* — HP Inc. Patent Department

(57) ABSTRACT

In an example implementation, a method of dual and single drop weight printing includes operating a printing system in a hybrid drop weight print mode to enable ejecting black ink from high drop weight nozzles and low drop weight nozzles, and ejecting color ink from high drop weight nozzles but not from low drop weight nozzles.

14 Claims, 6 Drawing Sheets

(56) References Cited

U.S. PATENT DOCUMENTS

| | | | | |
|---|---|---|---|---|
| 6,086,185 | A | 7/2000 | Inui et al. | |
| 6,352,330 | B1 | 3/2002 | Lubinsky et al. | |
| 6,402,280 | B2 | 6/2002 | Kneezel et al. | |
| 6,471,332 | B1 | 10/2002 | Vilanova et al. | |
| 6,601,937 | B2 * | 8/2003 | Hotomi | B41J 2/1433 347/15 |
| 9,303,142 | B2 † | 4/2016 | Usui | |
| 2002/0001005 | A1 | 1/2002 | Kneezel et al. | |
| 2003/0197760 | A1 * | 10/2003 | Tsuchii | B41J 2/1404 347/56 |
| 2006/0066655 | A1 | 3/2006 | Richard et al. | |
| 2008/0024574 | A1 | 1/2008 | Donaldson et al. | |
| 2011/0037799 | A1 * | 2/2011 | Nakano | B41J 2/2125 347/12 |
| 2012/0236057 | A1 | 9/2012 | Sakakibara | |

FOREIGN PATENT DOCUMENTS

| | | | | |
|---|---|---|---|---|
| CN | 101495318 | | 7/2009 | |
| CN | 101992593 | | 3/2011 | |
| JP | 3893724 | B2 * | 3/2007 | B41J 2/2125 |

* cited by examiner
† cited by third party

DUAL AND SINGLE DROP WEIGHT PRINTING

BACKGROUND

An inkjet web press is a high-speed, digital, industrial inkjet printing solution that prints on a print target such as a continuous media web at speeds of hundreds of feet per minute. In some examples, a roll of media (e.g., paper) on an unwinding device supplies the press with a paper web that is conveyed through the press along a media path. Stationary inkjet printheads along the media path eject droplets of printing fluid onto the web to form images. The paper web is then conveyed through a drying area and out of the press through rollers to be further processed and/or rewound on a rewinding device.

Inkjet web presses can have different printhead configurations depending on different customer applications. For example, some customer applications involve less color printing but significantly higher amounts of printing in mono, or black. In such cases, an inkjet web press may be configured with additional black printheads to accommodate higher speeds during the mono/black printing. In some inkjet web presses, for example, there can twice as many or more black printheads as there are color printheads, such as cyan, magenta, or yellow printheads.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
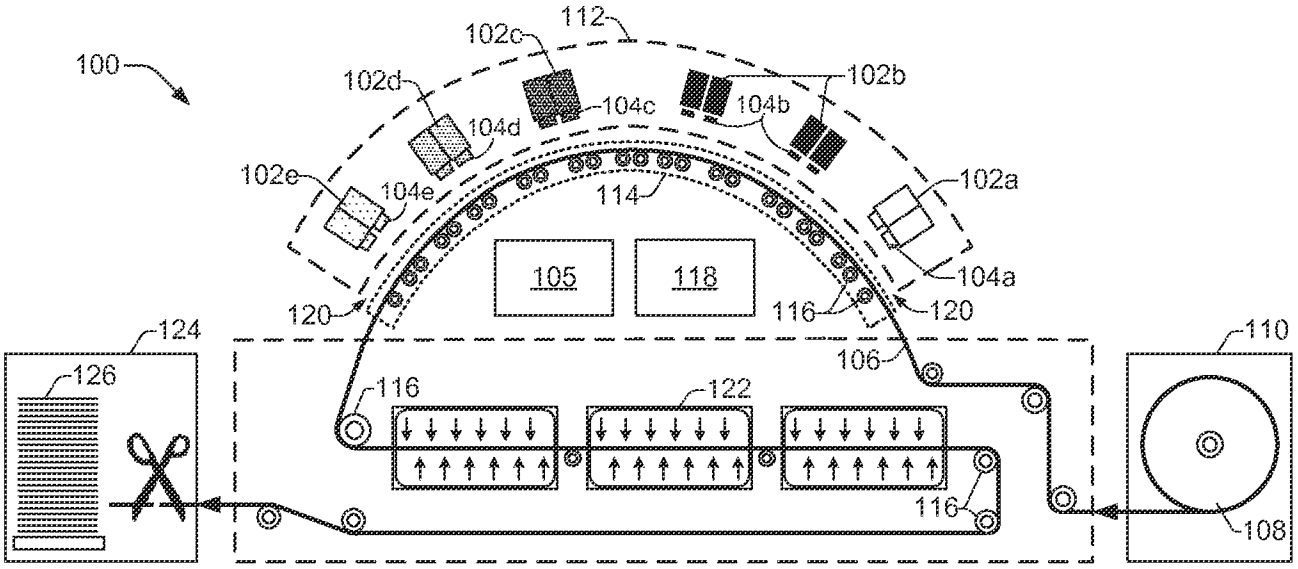
FIG. 1 shows a schematic illustration of an example printing system suitable for enabling a hybrid print mode that includes DDW (dual drop weight) printing from black printheads and SDW (single drop weight) printing from color printheads.

Inkjet web presses can provide different print modes that enable users to control some degree of quality and speed for the printed output. In some web presses, for example, a dual drop weight (DDW) print mode enables the printheads to eject ink (e.g., black, cyan, magenta, yellow) through both high drop weight (HDW) and low drop weight (LDW) print nozzles. In a single drop weight (SDW) print mode, such web presses enable printheads to eject ink through just the HDW print nozzles.

There can be tradeoffs between the DDW and SDW print modes. For example, the DDW print mode can provide additional quality through the use of the LDW print nozzles that provide smaller ink drops and sharper printed output. The print speed in the DDW print mode can be significantly reduced, however, due to having to send print data to both HDW and LDW nozzles, for example. In the SDW print mode, print data is sent to the HDW print nozzles but not the LDW print nozzles, which allows for higher print speeds. However, the HDW print nozzles produce larger ink drops that do not provide the same sharpness or quality in the printed output as the LDW print nozzles.

In some examples of inkjet web presses, there can be twice as many or more black printheads as there are for each of the other colors, such as cyan, magenta, or yellow printheads. While examples discussed herein refer generally to a four color printing system using CMYK, other systems are contemplated such as systems that use additional ink colors that can include, for example, cyan, magenta, yellow, black, a variety of special and spot color inks, such as white, orange, violet, silver, UV red, transparent, and so on. The additional black printheads enable increased printing speed when printing in mono/black, which is a common customer application. When printing color in the DDW print mode, the print speed is limited by the lower number of LDW nozzles in the color printheads. The color print speed can be increased by printing in the SDW print mode, which uses just the HDW nozzles for both black and color inks. However, because there are twice as many black printheads, the black printheads can print in DDW print mode using both HDW and LDW print nozzles, at the same speed that the color printheads can print in the SDW print mode using just HDW print nozzles. Consequently, for printing systems that have twice as many black printheads as color printheads, printing in the SDW print mode (i.e., using just the HDW print nozzles) in order to achieve a higher print speed, underutilizes the quality that is still available at that same print speed from the unused black LDW print nozzles. It has been determined that significant benefits in the overall print quality can be realized when printing in SDW print mode when the LDW black print nozzles can be used, even if the LDW color print nozzles cannot be used.

Accordingly, example methods and systems disclosed herein enable a hybrid print mode that includes DDW (dual drop weight) printing from black printheads and SDW (single drop weight) printing from color printheads. More specifically, in the hybrid, dual and single drop weight print mode, black printheads are enabled to print ink droplets from both HDW (high drop weight) nozzles and LDW (low drop weight) nozzles, while color printheads are limited to printing ink droplets from HDW nozzles. The hybrid print mode enables web press users operating presses with twice as many black printheads as color printheads, to maximize the overall print quality while printing at the maximum speed that is available from the color printheads (i.e., with color printheads printing in SDW/HDW mode).

In one example, a method of dual and single drop weight printing includes operating a printing system in a hybrid drop weight print mode to enable ejecting black ink from high drop weight nozzles and low drop weight nozzles, and ejecting color ink from high drop weight nozzles but not from low drop weight nozzles. In some examples, the printing system has twice the number of black print nozzles as color print nozzles for each of a plurality of colors.

In another example, a system for dual and single drop weight printing includes a number of color printheads for each of a plurality of colors, and a number of black printheads, wherein the number of black printheads is twice the number of color printheads for each of the plurality of colors. The system includes drop generators disposed in a first array and a second array on each printhead, the drop generators alternating between high drop weight (HDW) drop generators and low drop weight (LDW) drop generators. The system also includes a controller to cause dual drop weight printing in the black printheads to eject black ink from both HDW and LDW drop generators, and single drop weight printing in the color printheads to eject color ink from HDW drop generators but not from LDW drop generators.

In another example, a non-transitory machine-readable storage medium stores instructions that when executed by a processor of a printing device, cause the printing device to, while in a hybrid print mode, eject black ink using dual drop weight (DDW) drop generators, and eject color ink using single drop weight (SDW) drop generators. Ejecting black ink using DDW drop generators includes ejecting black ink using both high drop weight (HDW) and low drop weight (LDW) drop generators, and ejecting color ink using SDW drop generators includes ejecting color ink using HDW drop generators.

FIG. 1 shows a schematic illustration of an example printing system 100 suitable for enabling a hybrid print mode that includes DDW (dual drop weight) printing from black printheads and SDW (single drop weight) printing from color printheads. The example printing system 100 shown in FIG. 1 will be described herein as an inkjet web press 100 (i.e., a printing press 100). The example inkjet web press 100 includes a number of printbars 102 (illustrated as printbars 102*a*-102*e*), each of which includes 5 printheads 104 (illustrated as printheads 104*a*-104*e*). A bonding agent printbar 102A has 5 bonding agent printheads 104*a*, two black printbars 102*b* together have 10 black printheads 104*b*, a cyan printbar 102*c* has 5 cyan printheads 104*c*, a magenta printbar 102*d* has 5 magenta printheads 104*d*, and a yellow printbar 102*e* has 5 yellow printheads 104*e*. Thus, there are twice the number of black printheads 104*b* and print nozzles as there are printheads and print nozzles for any of the other colors.

While a particular printhead configuration is illustrated and discussed with reference to the printing system 100 in FIG. 1, there is no intent to limit the printhead configuration or other aspects of printing system 100 to such an implementation. Rather, the printing system 100 is provided merely by way of example, and the various concepts disclosed herein, including those regarding a hybrid, dual and single drop weight print mode, may be applicable to other configurations and types of printing systems as appropriate. Such other printing systems include systems where the number of black printheads/nozzles is twice the number of color printheads/nozzles for each of the available colors. For example, another example of a printing system may be an inkjet web press having one printbar for each of the colors cyan, magenta, and yellow, and two printbars for black, where each printbar includes 10 printheads. Thus, the example web press would have 20 black printheads on two printbars, 10 cyan printheads on one printbar, 10 magenta printheads on one printbar, and 10 yellow printheads on one printbar. In another example, the web press may have double the number of printbars shown in FIG. 1, where each printbar includes 5 printheads.

The ink jet printheads 104 of the inkjet web press 100 are designed to produce two drop sizes, referred to as interstitial dual drop weight (iDDW). The ink jet printheads 104 have two sizes of drop generators that each include a heater resistor and nozzle. As used herein, a drop generator is an apparatus that ejects an ink drop at a print medium. The drop generator includes an inflow region comprising a flow chamber that fluidically couples an ink source with an ejection chamber. The ejection chamber has a heating resistor on a surface, and a nozzle disposed proximate the heating resistor. When a firing pulse is applied to the heating resistor, a steam or solvent bubble is formed within the ejection chamber, which forces an ink drop out through the nozzle.

Each printhead 104 has multiple columns, or arrays, of drop generators that alternate between high drop weight (HDW) drop generators and low drop weight (LDW) drop generators. The HDW may be in the range of about 6-11 nanograms (ng), or about 9 ng, while the LDW may be in the range of about 3-5 ng, or about 4 ng. The drop generators share the same stack thickness for the fluidic channels (i.e., ink flow channels), and are centered on substantially the same pitch to assure correct drop placement (e.g., about 21.2 micrometers (μm) for 1200 dots per inch (dpi)).

The ink jet printheads 104 can provide a higher speed printing for text and graphics when using HDW drop generators, and a lower speed printing with increased quality for images when using reduced drop weight or LDW drop generators. In an example, a controller 105 may determine which type of drop generator to use depending on the print data being input, and/or the print mode selected by the web press operator/user. The controller 105 may use the HDW drop generators for high speed printing of text and graphics, the LDW drop generators for high quality printing of images, or a mixture of both the LDW and HDW drop generators for general purpose use. In some implementations, the controller 105 may determine when to use HDW and LDW drop generators depending on the types of drops being ejected. For example, HDW or LDW drop generators may be used depending on whether the drops being ejected are black drops or color drops, as discussed in greater detail below.

Figure 4:
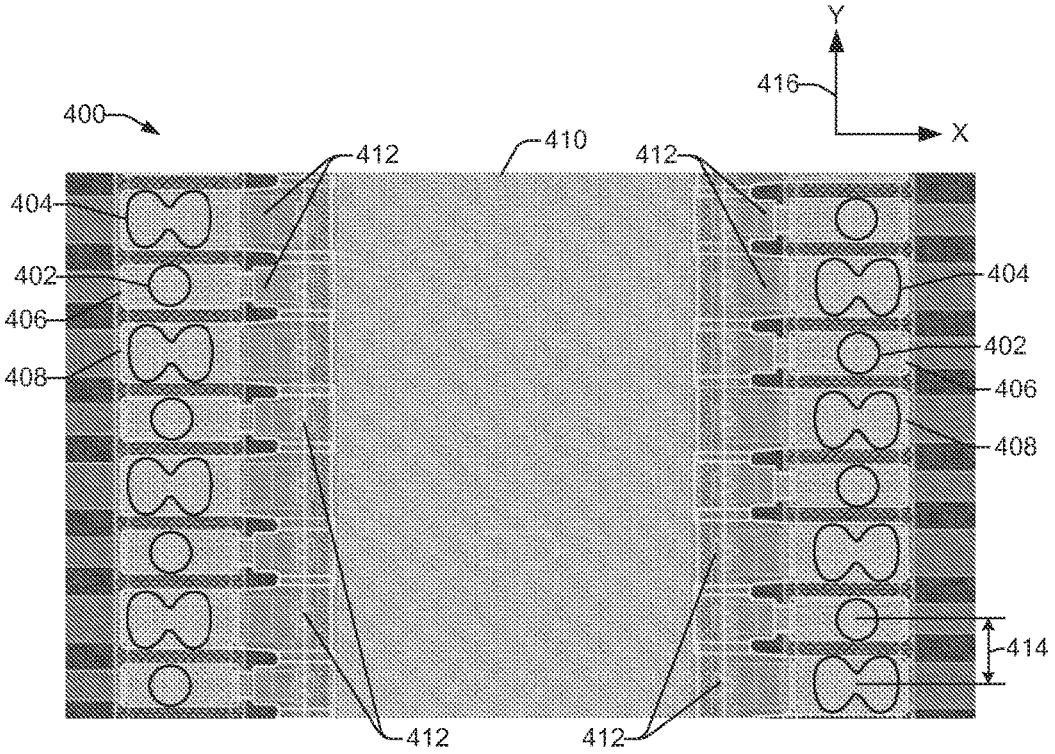
FIG. 4 shows a top view of an example printhead with adjacent nozzles over respective resistors.
Figure 5:
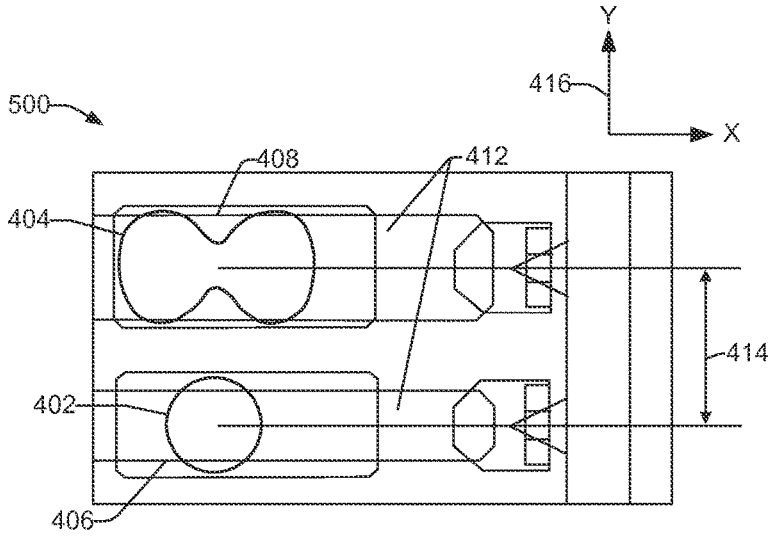
FIG. 5 shows a close up top view of examples of two drop generators with different nozzle designs.

Further, in some examples, the printed drop shapes and printhead layout are improved by using a non-circular bore (NCB) for the nozzles of the HDW drop generators and a circular bore (CB) for the nozzles of the LDW drop generators. The NCB allows the appropriate amount of bore area for a HDW drop generator to fit within available space in the Y axis of the printhead while also reducing the drop tail length, which gives crisp edges to lines and text. The circular bores used on the nozzles of the LDW drop generators pack well between the adjacent NCBs of the nozzles for the HDW drop generators, and they produce a longer drop tail that splits into two, or more, smaller drops. These small drops from the LDW generators with circular bores are ideal for reducing the graininess within images. While examples discussed herein include using NCB nozzles for the HDW drop generators, other examples can also include using CB nozzles for HDW drop generators. FIGS. 4 and 5 discussed below provide further illustration of the design and function of HDW and LDW drop generators and associated nozzles.

Figure 2A:
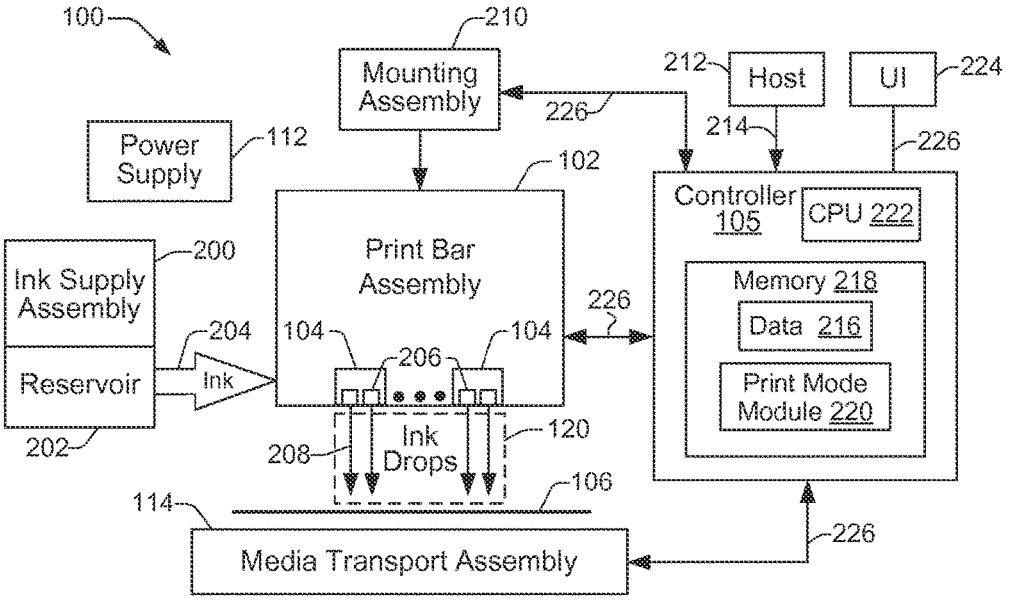
FIG. 2*a* shows a block diagram of the example printing system of FIG. 1.
Figure 2B:
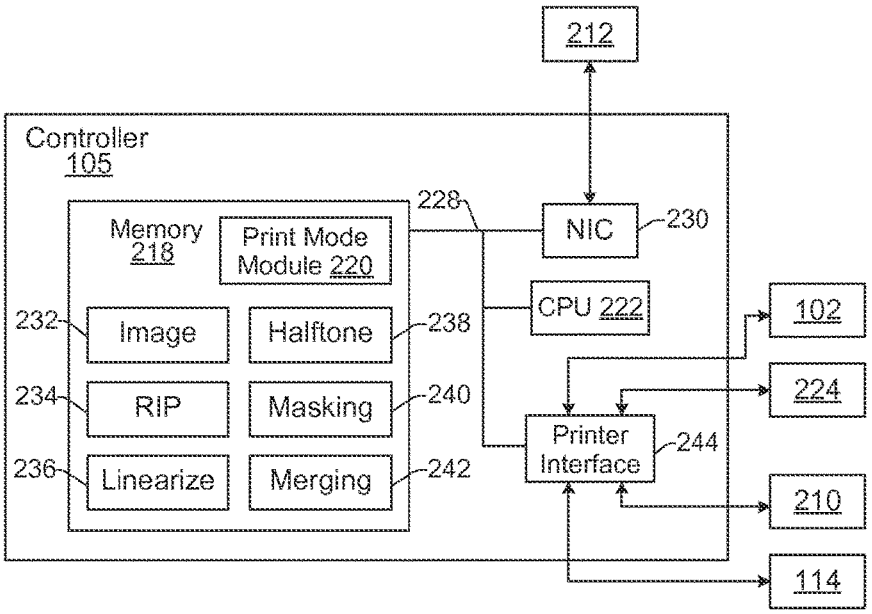
FIG. 2*b* shows a block diagram of the example controller of FIGS. 1 and 2*a;*

FIG. 2*a* is a block diagram of the example printing system 100 of FIG. 1, and FIG. 2*b* is a block diagram of the controller 105 of FIGS. 1 and 2*a*. FIGS. 2*a* and 2*b* further facilitate the description of the ink jet web press 100 that is enabled with a hybrid print mode that provides dual and single drop weight printing. Referring now generally to FIGS. 1 and 2, the example inkjet web press 100 is equipped to print ink or other fluid onto a print medium, such as a web of media 106, supplied by a media roll 108 from an unwinding device 110. The media web 106 comprises printing material such as cellulose-based material (i.e., paper) or polymeric material, for example. The width of the media web 106 can vary, but is on the order of 20-40 inches.

The media web 106 can be fed through a number of printing systems, such as printing system 112. In the example web press 100 of FIG. 1, a single printing system 112 is shown. However, in some examples, additional printing systems may be included that form full or partial arcs, similar to printing system 112. In general, any number of systems may be used, depending, for example, on the colors desired and the speed of the printing press 100. In printing system 112, a number of printbars 102 each house a number of printheads 104 that eject ink drops or other fluid drops onto the paper web 106 as it travels along a media support 114. For example, printing system 112 may print black (K), cyan, magenta, and yellow (CMY) onto media web 106. Media support 114 comprises a number or media rollers 116 driven by a web drive 118. The media rollers 116 support the media web 106 as it passes through a print zone 120 in close proximity to the printheads 104. As the media web 106 passes through the print zone 120 it becomes wet from ink and/or other fluid ejected from printheads 104. The inkjet web press 100 includes one or more thermal dryers 122 that remove the moisture from the web 106 by forcing warm air across the web as it passes over a series of rollers.

As the media web 106 exits the printing press 100, it may be rewound on a rewinding device and subsequently transferred to a near-line finishing device, or it may pass directly to a post-print, in-line finishing device 124, as shown in FIG. 1. Finishing devices 124 perform finishing operations on printed material after printing has been completed. Such operations include, for example, paper slitting, cutting, trimming, die-cutting, folding, coating, embossing, and binding. The example finishing device 124 comprises a cutting and stacking device that cuts the printed web 106 into pages and organizes the pages into a stack 126.

The printing press 100 may have a high speed of operation and printing, and the design of the printheads may be a factor in achieving this speed. In one example, the media web 106 may be moving as fast as about 800 feet per minute, or about 244 meters per minute. Further, the printing press 100 may print about 129 million letter-sized images per month. As noted above, the techniques described herein are not limited to the printing press 100 of FIG. 1, but they may be applicable to other ink jet printing systems, for example, ranging from a personal printer to the printing press 100.

Referring to FIG. 2*a*, the ink jet printing press 100 includes a printbar 102, that includes a number of printheads 104, and an ink supply assembly 200. The ink supply assembly 200 includes an ink reservoir 202. From the ink reservoir 202, ink 204 is provided to the printbar 102 to be fed to the printheads 104. The ink supply assembly 200 and printbar 102 may use a one-way ink delivery system or a recirculating ink delivery system. In a one-way ink delivery system, substantially all of the ink supplied to the printbar 102 is consumed during printing. In a recirculating ink delivery system, a portion of the ink supplied to the printbar 102 is consumed during printing, and another portion of the ink is returned to ink supply assembly 200. In an example, the ink supply assembly 200 is separate from the printbar 102, and supplies the ink 204 to the printbar 102 through a tubular connection, such as a supply tube (not shown). In other examples, the printbar 102 may include the ink supply assembly 200, and ink reservoir 202, along with a printhead 104, for example, in single user printers. In either example, the ink reservoir 202 of the ink supply assembly 200 may be removed and replaced, or refilled.

From the printheads 104, the ink 204 is ejected from print nozzles 206 as ink drops 208 towards a print medium 106 (e.g., media web 106), such as paper. In some examples, other media, such as treated papers that enhance adhesion, may be used. The nozzles 206 of printheads 104 are arranged in one or more columns or arrays such that properly sequenced ejection of ink 204 can form characters, symbols, graphics, or other images to be printed on the print medium 106 as the printbar 102 and print medium 106 are moved relative to each other. The ink 204 is not limited to colored liquids used to form visible images on paper. For example, the ink 204 may be an electro-active substance used to print circuits and other items, such as solar cells. Furthermore, other types of materials, such as metallic or magnetic inks 204 may be used. In some examples, the printing system 100 may be used for other types of applications, such as three dimensional printing and digital titration, among others. In those examples, the inks 204 can encompass any number of other chemicals, such as acids, bases, plastic fluids, medical testing fluids, and the like.

In examples described herein, the printheads 104 have an iDDW (interstitial dual drop weight) design. In the iDDW design, one of two different sized ink drops 208 may be ejected from the printheads 104 depending on the types of images to be printed. It is desirable for the ink jet printing system 100 to maintain a high printing speed, and, thus, the printheads 104 may be designed to provide a similar speed for printing using each drop size. However, in some examples, the printing speed may be adjusted depending on the ratio of the types of drops, e.g., HDW to LDW.

A mounting assembly 210 may be used to position the printbar 102 relative to the print medium 106. In an example, the mounting assembly 210 may be in a fixed position, holding a number of printheads 104 above the print medium 106. In another example, the mounting assembly 210 may include a motor that moves the printbar 102 back and forth across the print medium 106, for example, if the printbar 102 includes one to four printheads 104. A media transport assembly 114 (e.g., media support 114) moves the print medium 106 relative to the printbar 102, for example, moving the print medium 106 perpendicular to the printbar 102. In the example of FIG. 1, the media transport assembly 114 may include the rollers 116, as well as any number of motorized pinch rollers (not shown) used to pull the paper media web 106 through the printing systems 112. If the printbar 102 is moved, the media transport assembly 114 may index the print medium 106 to new positions. In examples in which the printbar 102 is not moved, the media transport assembly 114 may move the print medium 106 continuously.

A controller 105 receives data from a host system 212, such as a computer. The data may be transmitted over a network connection 214, such as an electrical connection, an optical fiber connection, or a wireless connection, among others. The data 216 may include a document or file to be printed, or may include more elemental items, such as a color plane of a document or a rasterized document. The controller 105 may temporarily store the data 216 in a local memory 218 for analysis. Memory 218 can include both volatile (i.e., RAM) and nonvolatile (e.g., ROM, hard disk, optical disc, CD-ROM, magnetic tape, flash memory, etc.) memory components. The components of memory 218 comprise non-transitory, machine-readable (e.g., computer/processor-readable) media that provide for the storage of machine-readable coded program instructions, data structures, program instruction modules, JDF (job definition format), and other data for the printing press 100, such as module 220. The program instructions, data structures, and modules stored in memory 218 may be part of an installation package that can be executed by a processor (CPU) 222 to implement various examples, such as examples discussed herein. Thus, memory 218 may be a portable medium such as a CD, DVD, or flash drive, or a memory maintained by a server from which the installation package can be downloaded and installed. In another example, the program instructions, data structures, and modules stored in memory 218 may be part of an application or applications already installed, in which case memory 218 may include integrated memory such as a hard drive.

The analysis of data 216 may include the execution of coded instructions (e.g., instructions in print mode module 220) by a processor (CPU) 222, firmware and/or other electronics in order to communicate with and control the components of the inkjet web press 100, as well as external devices such as unwinding device 110. One such component of web press 100 includes a user interface 224. User interface 224 enables a press operator/user to manage various aspects of printing, such as loading and reviewing print jobs, proofing and color matching print jobs, handling media substrates, selecting or entering different print modes, and so on. The user interface 224 typically includes a touch-sensitive display screen that allows the operator to interact with information on the screen, make entries on the screen, and generally control the web press 100. A user interface 224 may also include other devices such as a key pad, a keyboard, a mouse, and a joystick, for example. The analysis of data 216 may include determining timing control for the ejection of ink drops 208 from the printheads 104, as well as the motion of the print medium 106 and any motion of the printbar 102. The controller 105 may operate the individual parts of the printing system 100 over control lines 226. Through such operation, the controller 105 defines a pattern of ejected ink drops 208 which form characters, symbols, graphics, or other images on the print medium 106. For example, the controller 105 may determine when to use HDW drop generators and LDW drop generators for printing a particular image, as described further with respect to FIG. 2*b*.

FIG. 2*b* is a block diagram of the controller 105 of FIGS. 1 and 2*a*. As noted above, the controller 105 includes processor 222 to execute instructions stored in memory 218. Controller 105 is coupled though a bus 228 to memory 218. The processor 222 can be a single core processor, a multi-core processor, a computing cluster, or any number of other configurations. A network interface controller (NIC) 230 may be coupled to the processor 222 through the bus 228. The NIC 230 may couple the controller 105 to the host 212 through a network, such as a local area network (LAN), a wide area network (WAN), or the Internet, among others.

As noted above, memory 218 may include a number of modules, or blocks of processor-executable instructions/code, used to provide functionality to the ink jet printing system 100, such as print mode module 220. Print mode module 220 includes executable instructions to enable controller 105 to determine which type of drop generator to use during printing. For example, executing instructions from print mode module 220, controller 105 may determine which type of drop generator to use depending on the print data being input, and/or depending on the print mode selected by the web press operator/user through the user interface 224. Thus, the selection of a print mode can be made automatically by controller 105 based on the print data 216 received, or the print mode can be set by controller 105 on the receipt of a print mode input selection made by a web press operator via user interface 224.

The print mode module 220 enables at least 3 print modes that include a DDW (dual drop weight) print mode, a SDW (single drop weight) print mode, and a hybrid print mode. The DDW print mode causes the web press printheads 104 to eject fluid drops from both HDW (high drop weight) and LDW (low drop weight) drop generators and associated print nozzles. The SDW print mode causes the web press printheads 104 to eject fluid drops from HDW drop generators and associated print nozzles, but not from LDW drop generators. The hybrid print mode causes the web press printheads 104 to operate in a DDW print mode with respect to black printheads 104*b* and a SDW print mode with respect to color printheads 104*c* (cyan), 104*d* (magenta), and 104*e* (yellow). Thus, in hybrid print mode, both HDW and LDW drop generators and associated print nozzles on the black printheads 104*b* will eject black ink, while just HDW drop generators and associated nozzles on the color printheads (104*c* cyan, 104*d* magenta, 104*e* yellow) will eject color ink.

Additional instruction modules stored in memory 218 can include an image module 232 to direct the processor 222 to obtain and store an image, such as a document, from the host 212. The image may be a picture, a text document, a portable document format (PDF) file, or any number of other files. A RIP module 234 includes code to direct the processor 222 to rasterize the image. The rasterization divides the image into layers, or rasters, wherein each raster represents a color of ink, that when combined, will give the initial image color. For example, one rasterization technique divides the image into CMYK rasters. CMYK represents cyan, magenta, yellow, and black rasters. The CMYK rasters may be used to represent all colors in a cost effective manner. Other raster schemes may be used, such as six plane schemes that use specialty colors to enhance image reproduction. For example, one such scheme, termed Hexachrome, adds orange and green inks to the standard CMYK palette to enhance the appearance of the printed document.

A linearization module 236 can use one-dimensional tables to divide each raster into two planes, one plane representing the HDW drops, and one plane representing the LDW drops. A half toning module 238 uses a breakpoint table to convert the continuous color tone of each plane into individual drops. For example, the breakpoint table may represent intensity levels over a certain area of the plane that correspond to no ink drop, one ink drop, or two ink drops. A masking module 240 divides the drops of the halftones planes among the printbar 102, and printheads 104. This creates a map of the print output. A printing module 242 merges the LDW planes with the HDW planes for each color, and sends the resulting control data to the printbars 102 and printheads 104. For example, the processor 222 may send the control data over a printer interface 244 coupled to the bus 228. Other control data, such as data to and from UI 224, mounting assembly 210, and media transport assembly 114 can also be communicated over printer interface 244.

The controller 105 for the ink jet printing system 100 is not limited to the configurations described with respect to FIG. 2*b*, but may include any number of other configurations. For example, the code of the modules may be arranged in any number of other configurations while retaining the same general function. In another example, the modules may be shifted off of the controller 105, and may be run remotely, such as by the host 212.

Figure 3:
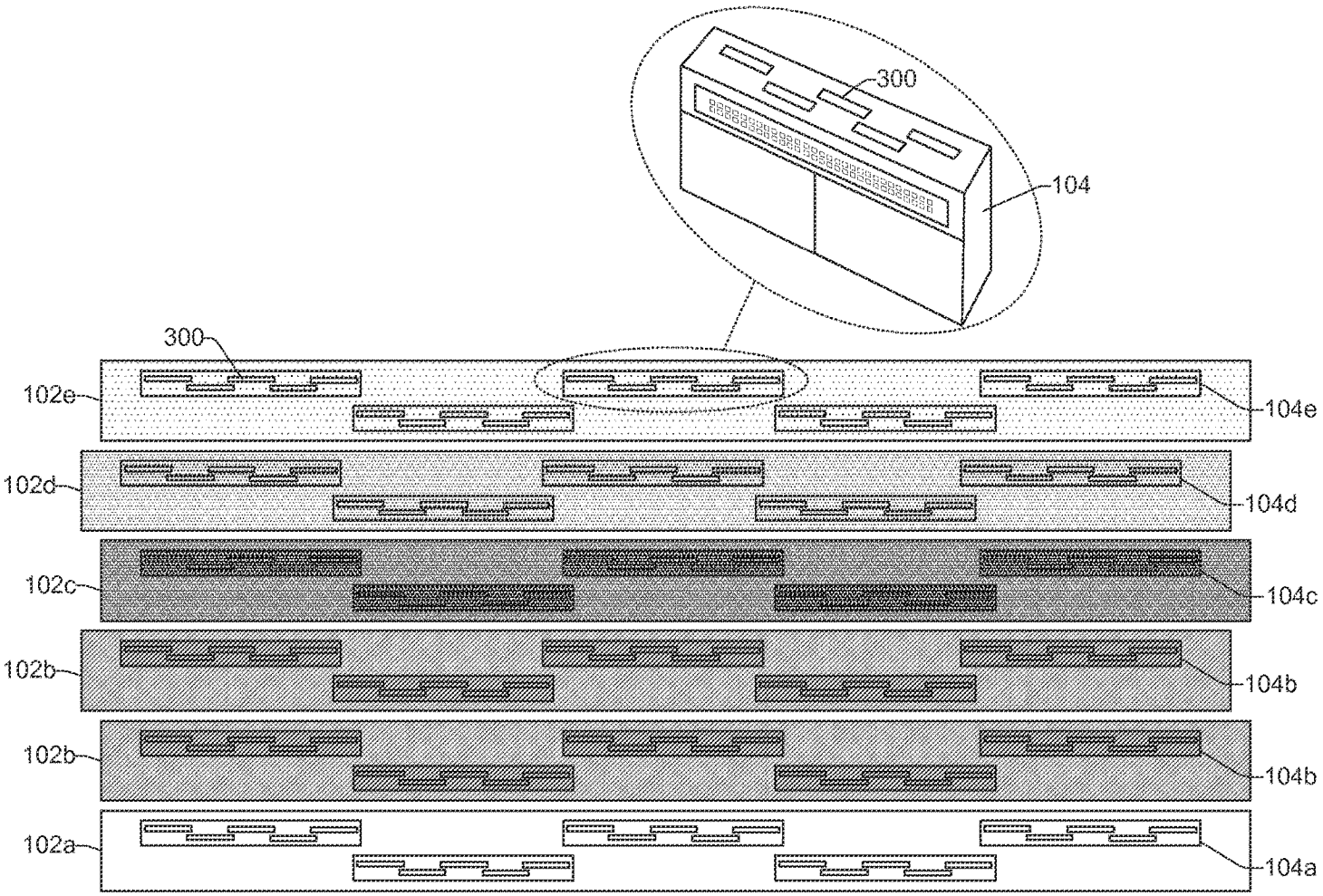
FIG. 3 shows an example of a number of printbars in a print zone layout of an example ink jet web press printing system.

FIG. 3 shows an example of a number of printbars 102 (102*a*-102*e*) in a print zone layout of the example ink jet web press printing system 100. In this example, each printbar 102 has 5 printheads 104 that overlap one another along the length of the printbar 102 to provide full ink drop coverage across the width of the print media web 106 as the media web 106 travels through printing system 112. In other examples, the printbars 102 may have a different number of printheads 104. For example, in another implementation, each printbar 102 may have 10 printheads 104 along its length. In any case, each printbar 102 will have the same number of printheads 104 as each of the other printbars 102. Moreover, regardless of the overall number of printbars 102 or printheads 104, the ink jet web press system 100 disclosed herein will have twice the number of black printheads 104*b* as it has any of the other individual colored printheads 104*c* (cyan), 104*d* (magenta), and 104*e* (yellow). Thus, as shown in FIG. 3, the web press 100 has 10 black printheads 104*b* along 2 black printbars 102*b*, and 5 color printheads 104*c*, 104*d*, and 104*e*, respectively, for each of the colors cyan, magenta, and yellow. While the example in FIG. 3 shows each color printbar 102*c*, 102*d*, and 102*e*, having just a single color printhead, other configurations are possible in which a color printbar includes two different printhead colors. For example, printbars 102*c* and 102*d* may be configured with half cyan printheads on one side of the printbar and half magenta printheads on the other side of the printbar.

Each printhead 104 has multiple nozzle regions 300 that include columns of print nozzles 206 that alternate between HDW drop generators and LDW drop generators. Each nozzle region 300 comprises part of a printhead die on a printhead 104. In this example, each printhead 104 includes 5 printhead dies, each with a nozzle region 300. A printhead die includes end regions, a nozzle region 300, and many drop generators within the nozzle region 300. A drop generator comprises an ejection chamber, a heating resistor, corresponding fluid passage(s), and an HDW or LDW nozzle 206 through which fluid/ink drops can be ejected from the chamber by heat from the heating resistor. The nozzle region 300 is disposed between the end regions of the printhead die, and the print nozzles 206 are disposed on the surface of the nozzle region 300.

FIG. 4 shows a top view of an example printhead 400 with adjacent nozzles 402 and 404 over resistors 406 and 408, respectively. For simplicity, a representative sample of each of the nozzles 402 and 404 and resistors 406 and 408 are labeled. A smaller nozzle 402 is located over a narrower resistor 406 to provide the LDW drop, for example, about 4 nanograms (ng) in weight. A larger nozzle 404 is located over a wider resistor 408 to provide the HDW drop, for example, about 9 ng in weight. An ink refill region 410 is coupled to each nozzle 402 and 404 through an inflow region 412. To simplify the drawing, a portion of the inflow regions are labeled.

The resistor pitch 414 may be constant, for example, at about 21.1 μm in the y-direction 416, corresponding to about 1200 dots per inch (dpi), in order to assure correct drop placement. An HDW drop generator includes a larger nozzle 404, a wider resistor 408, an ejection chamber located proximate to the nozzle and resistor, and an associated inflow region 412. An LDW drop generator includes a smaller nozzle 402, a narrower resistor 406, an ejection chamber located proximate to the nozzle and resistor, and an associated inflow region 412.

FIG. 5 shows a close up top view 500 of two drop generators, with the different nozzle designs. Like numbered items are as described with respect to FIG. 4. In examples described herein, the layout of the top layer, e.g., the nozzles 402 and 404, is used to create a printhead that can print multiple drop sizes on pitch. As described herein, the drop weight and drop velocity are dependent upon the interaction of the area of the resistors 406 and 408 and the bore, or area, of the nozzles 402 and 404. For example, a bore for a 9-10 ng drop is in the range of between about 280 to 340 μm^2 while a bore for a 3-4 ng drop is between about 160 to 200 μm^2. If the nozzles were circular, the diameters would be about 19-20 μm and 12-14 μm respectively. As the wall between each drop generator is about 5 μm, the spacing for a 21.5 μm pitch would be about 32 μm. The diameters described above would not fit within this measurement.

However, the use of a two-lobed polynomial ellipse as a non-circular bore (NCB) for the nozzle 404 of the HDW drop generator reduces the extent of the bore in the y-direction 416, allowing the nozzle 404 to fit on the pitch. Further, the location of the smaller circular bore (CB) of the nozzle 402 for the LDW drop generator falls in a position that maximizes the space between the nozzles 402 and 404. This increases the mechanical strength of the structure and limits fluidic interactions between the nozzles 402 and 404.

Figure 6:
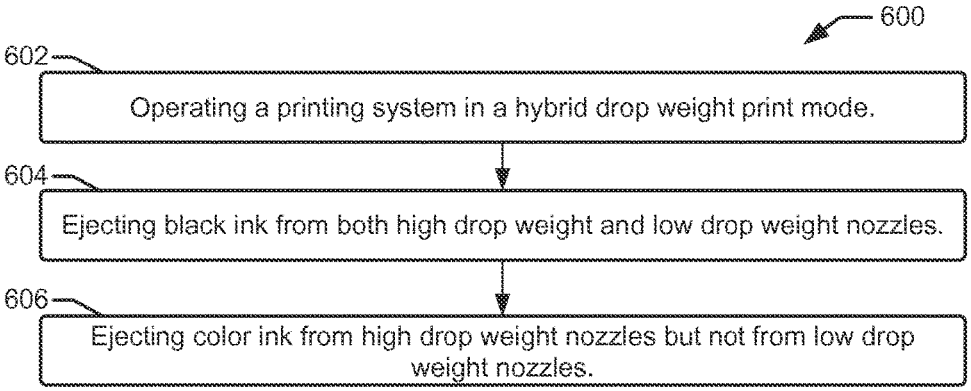
FIGS. 6, 7 and 8 show flow diagrams that illustrate example methods related to providing a hybrid print mode in a web press printing system that includes a DDW printing mode for black printheads and a SDW printing mode for color printheads.
Figure 7:
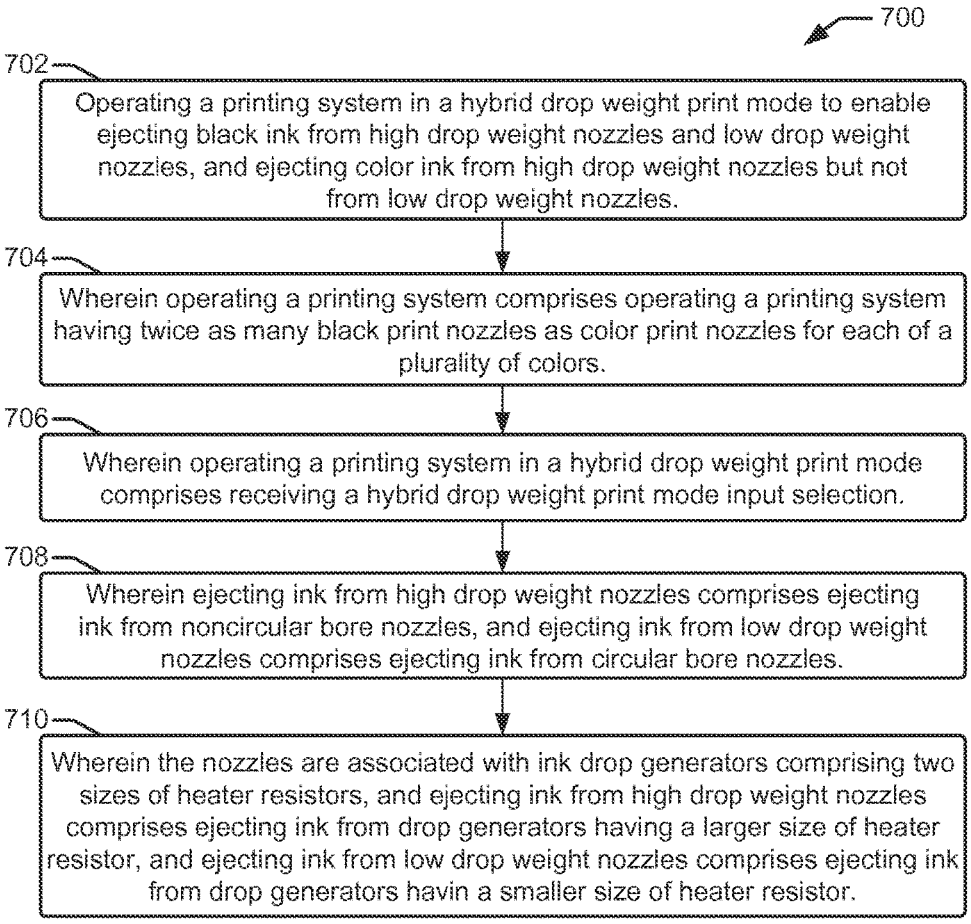
Figure 8:
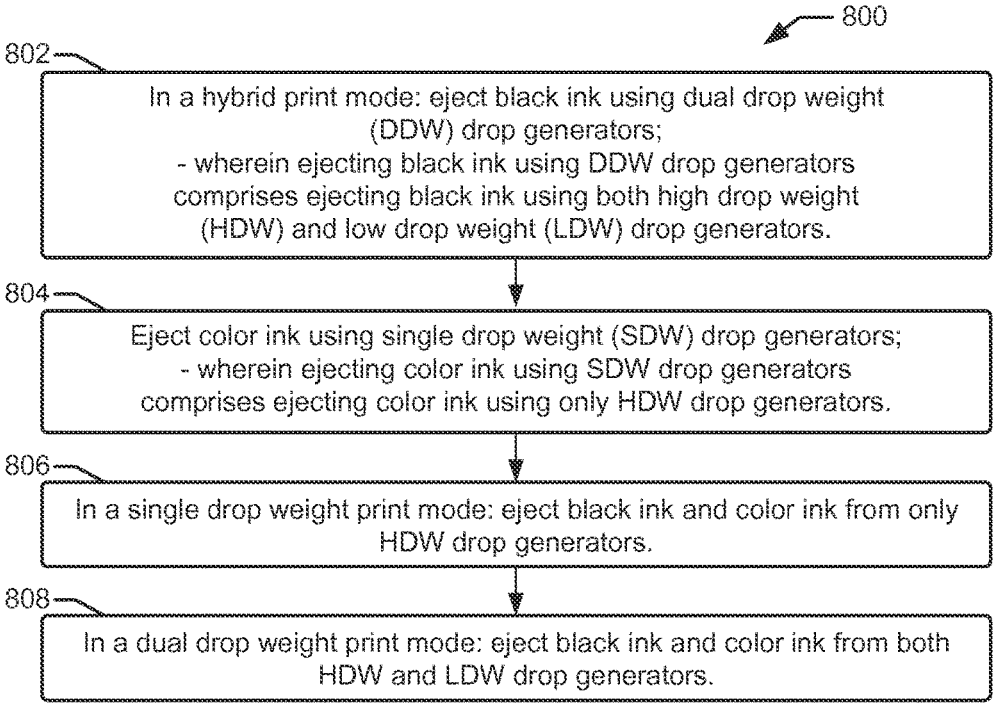

FIGS. 6, 7 and 8 show flow diagrams that illustrate example methods 600, 700 and 800, respectively, related to providing a hybrid print mode in a web press printing system 100 that includes a DDW printing mode for black printheads and a SDW printing mode for color printheads. Methods 600-800 are associated with the examples discussed herein with regard to FIGS. 1, 2*a*, 2*b*, 3, 4, and 5, and details of the operations shown in these methods can be found in the related discussion of such examples. The operations of methods 600-800 may be embodied as programming instructions stored on a non-transitory, machine-readable (e.g., computer/processor-readable) medium, such as the memory 218 shown in FIGS. 2*a* and 2*b*. In some examples, implementing the operations of methods 600-800 can be achieved by a processor, such as a processor 222 shown in FIGS. 2*a* and 2*b*, reading and executing programming instructions such as instructions from module 220 stored in memory 218. In some examples, implementing the operations of methods 600-800 can be achieved using engines of a 3D printing system that include combinations of hardware such as an ASIC (application specific integrated circuit) and/or other hardware components, alone or in combination with programming instructions executable by a processor.

In some examples, methods 600-800 may include more than one implementation, and different implementations of methods 600-800 may not employ every operation presented in the respective flow diagrams of FIGS. 6-8. Therefore, while the operations of methods 600-800 are presented in a particular order within the flow diagrams, the order of their presentation is not intended to be a limitation as to the order in which the operations may actually be implemented, or as to whether all of the operations may be implemented. For example, one implementation of method 700 might be achieved through the performance of a number of initial operations, without performing one or more subsequent operations, while another implementation of method 700 might be achieved through the performance of all of the operations.

Referring now to the flow diagram of FIG. 6, an example method 600 of dual and single drop weight printing begins at block 602 with operating a printing system in a hybrid drop weight print mode. As shown at blocks 604 and 606, respectively, operating the printing system in a hybrid drop weight print mode includes ejecting black ink from both high drop weight and low drop weight nozzles, and ejecting color ink from high drop weight nozzles but not from low drop weight nozzles.

Referring now to the flow diagram of FIG. 7, an example method 700 of dual and single drop weight printing will be discussed in which operations are included that are in addition to, or are an alternative to, some of the operations of method 600. Method 700 begins at block 702 with operating a printing system in a hybrid drop weight print mode to enable ejecting black ink from high drop weight nozzles and low drop weight nozzles, and ejecting color ink from high drop weight nozzles but not from low drop weight nozzles. As shown at block 704, in some examples of method 700, operating a printing system comprises operating a printing system that has twice as many black print nozzles as color print nozzles for each of a plurality of colors. That is, for each color of print nozzles, such as cyan, magenta, and yellow print nozzles, the printing system has twice the number of black print nozzles as cyan print nozzles, or magenta print nozzles, or yellow print nozzles.

In some examples of method 700, as shown at block 706, operating a printing system in a hybrid drop weight print mode comprises receiving a hybrid drop weight print mode input selection. A hybrid drop weight print mode selection can be received, for example, from a web press operator through a user interface and/or from a web press controller based on print data received from a host computer. As shown at block 708, ejecting ink from high drop weight nozzles can include ejecting ink from noncircular bore nozzles, and ejecting ink from low drop weight nozzles can include ejecting ink from circular bore nozzles. As shown at block 710, in some examples the nozzles are associated with ink drop generators comprising two sizes of heater resistors, and ejecting ink from high drop weight nozzles comprises ejecting ink from drop generators having a larger size of heater resistor, and ejecting ink from low drop weight nozzles comprises ejecting ink from drop generators having a smaller size of heater resistor.

Referring now to the flow diagram of FIG. 8, an example method 800 related to dual and single drop weight printing begins at block 802. As shown at block 802, when in a hybrid print mode, the method includes ejecting black ink using dual drop weight (DDW) drop generators. Ejecting black ink using DDW drop generators comprises ejecting black ink using both high drop weight (HDW) and low drop weight (LDW) drop generators.

As shown at block 804, when in the hybrid print mode, the method 800 includes ejecting color ink using single drop weight (SDW) drop generators. Ejecting color ink using SDW drop generators comprises ejecting color ink using HDW drop generators and not using LDW drop generators.

As shown at block 806, when in a single drop weight print mode, the method 800 includes ejecting black ink and color ink from HDW drop generators and not from LDW drop generators. As shown at block 808, when in a dual drop weight print mode, the method 800 includes eject black ink and color ink from both HDW and LDW drop generators.

What is claimed is:

1. A method of dual and single drop weight printing comprising:

ejecting black ink from available high drop weight nozzles and available low drop weight nozzles arranged in an alternating manner along a single column of print nozzles, and ejecting color ink only from available high drop weight nozzles arranged in an alternating manner with low drop weight nozzles along a single column of print nozzles.

2. A method as in claim 1, wherein ejecting black ink and ejecting color ink comprises ejecting ink in a printing system having twice as many black print nozzles as color print nozzles for each of a plurality of colors.

3. A method as in claim 1, wherein dual and single drop weight printing comprises:

receiving a hybrid drop weight print mode input selection; and, in response to the hybrid drop weight print mode, ejecting black ink from available high drop weight nozzles and available low drop weight nozzles, and ejecting color ink from available high drop weight nozzles but not from available low drop weight nozzles.

4. A method as in claim 1, wherein:

ejecting ink from high drop weight nozzles comprises ejecting ink from noncircular bore nozzles; and ejecting ink from low drop weight nozzles comprises ejecting ink from circular bore nozzles.

5. A method as in claim 1, wherein the nozzles are associated with ink drop generators comprising two sizes of heater resistors, and wherein:

ejecting ink from high drop weight nozzles comprises ejecting ink from drop generators comprising a larger size of heater resistor; and ejecting ink from low drop weight nozzles comprises ejecting ink from drop generators comprising a smaller size of heater resistor.

6. A system for dual and single drop weight printing comprising:

a number of color printheads for each of a plurality of colors;

a number of black printheads, wherein the number of black printheads is twice the number of color printheads for each of the plurality of colors;

drop generators disposed in a first array and a second array on each printhead, the drop generators alternating between high drop weight (HDW) drop generators and low drop weight (LDW) drop generators; and a controller to cause dual drop weight printing in the black printheads to eject black ink from both HDW and LDW drop generators, and single drop weight printing in the color printheads to eject color ink from HDW drop generators but not from LDW drop generators.

7. A system as in claim 6, further comprising:

a user interface; and a hybrid print mode option selectable from the user interface to enable the dual and single drop weight printing.

8. A system as in claim 6, comprising a nozzle with a circular bore on each LDW drop generator and a nozzle with a non-circular bore on each HDW drop generator.

9. A system as in claim 6, wherein colors from the plurality of colors are selected from the group consisting of cyan, magenta, yellow, white, orange, violet, silver, UV red, transparent, and combinations thereof.

10. A system as in claim 6, wherein:

the drop generators in the first and second array are spaced one dot pitch apart, perpendicular to a motion of a print medium; and each drop generator in the first array is in a line of the motion of the print medium with a corresponding drop generator in the second array, wherein each HDW drop generator in the first array is in line with an LDW drop generator in the second array, and each LDW drop generator in the first array is in a line of the motion of the print medium with an HDW drop generator in the second array.

11. A system as in claim 10, comprising a memory to store instructions executable on a processor to cause the system to adjust a speed of the print medium through the system based, at least in part, on a ratio of HDW drops to LDW drops.

12. A non-transitory machine-readable storage medium storing instructions that when executed by a processor of a printing device, cause the printing device to:

eject black ink from both high drop weight (HDW) and low drop weight (LDW) drop generators arranged in an alternating manner along a single column of print nozzles; and, eject color ink only from HDW drop generators arranged in an alternating manner with LDW drop generators along a single column of print nozzles.

13. A medium as in claim 12, the instructions further causing the printing device to:

eject black ink and color ink from HDW drop generators but not from available LDW drop generators.

14. A medium as in claim 12, the instructions further causing the printing device to:

eject black ink and color ink from both HDW and LDW drop generators.

* * * * *